US011850610B2

(12) United States Patent
Burkart et al.

(10) Patent No.: US 11,850,610 B2
(45) Date of Patent: Dec. 26, 2023

(54) NON-LINEAR SPRAY PATTERN NOZZLES

(71) Applicant: ICP CONSTRUCTION, INC., Andover, MA (US)

(72) Inventors: Karl W. Burkart, Akron, OH (US); Christopher D. Dolezal, Canton, OH (US); Dujuan McClendon, Jr., Akron, OH (US)

(73) Assignee: ICP CONSTRUCTION, INC., Andover, MA (US)

( * ) Notice: Subject to any disclaimer, the term of this patent is extended or adjusted under 35 U.S.C. 154(b) by 206 days.

(21) Appl. No.: 17/020,903

(22) Filed: Sep. 15, 2020

(65) Prior Publication Data

US 2022/0080433 A1 Mar. 17, 2022

(51) Int. Cl.
*B05B 1/26* (2006.01)
*B05B 12/00* (2018.01)
*B05B 15/65* (2018.01)

(52) U.S. Cl.
CPC ..... *B05B 1/267* (2013.01); *B05B 12/004* (2013.01); *B05B 15/65* (2018.02)

(58) Field of Classification Search
CPC ..... B05B 12/004; B05B 15/65; B05B 1/267
USPC ..... 239/71
See application file for complete search history.

(56) References Cited

U.S. PATENT DOCUMENTS

| | | | | | |
|---|---|---|---|---|---|
| 2,768,101 | A * | 10/1956 | Fairchild | B08B 3/028 | 134/34 |
| 3,082,961 | A * | 3/1963 | Hruby, Jr. | F28F 25/06 | 239/200 |
| 3,085,754 | A * | 4/1963 | Thompson | B05B 1/304 | 239/582.1 |
| 3,342,423 | A * | 9/1967 | Hruby, Jr. | B05B 1/3026 | 239/590.5 |
| 4,353,508 | A * | 10/1982 | Butterfield | B05B 1/267 | 239/590.3 |
| 5,333,794 | A * | 8/1994 | Haruch | B05B 1/267 | 239/524 |
| 7,717,357 | B2 * | 5/2010 | Gantenbein | E04F 21/12 | 239/432 |
| 9,630,767 | B2 * | 4/2017 | Gantenbein | B65D 83/28 | |
| 10,350,617 | B1 * | 7/2019 | Slutskii | B05B 7/0025 | |
| 2016/0023225 | A1 | 1/2016 | Decker | | |
| 2020/0047201 | A1 | 2/2020 | Parks et al. | | |

* cited by examiner

*Primary Examiner* — Chee-Chong Lee
(74) *Attorney, Agent, or Firm* — Fredrikson & Byron, P.A.

(57) ABSTRACT

The invention pertains generally to removable spray tip nozzles that change the direction of the aerosol path from collinear with the nozzle tip body to non-collinear with the nozzle tip body.

7 Claims, 12 Drawing Sheets

NON-LINEAR SPRAY PATTERN NOZZLES

CROSS-REFERENCE TO RELATED APPLICATIONS

None.

TECHNICAL FIELD

The invention described herein pertains generally to non-linear spray pattern nozzles, e.g., nozzles which have a directed spray stream which is not collinear with the longitudinal axis of the nozzle.

BACKGROUND OF THE INVENTION

The invention relates to a novel spray nozzle in which the exit path of the ejected liquid aerosol particles and/or droplets are directed laterally and peripherally away from the longitudinal axis of the nozzle. This permits the end-user to spray, e.g., foams, in tight corners of buildings or anywhere it is desired to direct a stream of particles off-center from the longitudinal axis of the nozzle.

At least one exemplary purpose associated with the technology is to facilitate an end-user applying foam into the corners of a joist of a building.

This invention is particularly suited for in-situ applications of liquid chemicals mixed and dispensed as a spray or a foam and more specifically, to in-situ application of polyurethane foam or froth and optionally, the measurement of the temperature of the chemicals used therewith. In-situ applications for polyurethane foam have continued to increase in recent years extending the application of polyurethane foam beyond its traditional uses in the packaging, insulation and molding fields. For example, polyurethane foam is being used with increasing frequency as a sealant in the building trades for sealing spaces between windows and door frames and the like and as an adhesive for gluing flooring, roof tiles, and the like.

Polyurethane foam for in-situ applications is typically supplied as a "one-component" froth foam or a "two-component" froth foam in portable containers hand carried and dispensed by the operator through either a valve or a gun. However, the chemical reactions producing the polyurethane froth foam in a "one-component" polyurethane foam is significantly different than the chemical reactions producing a polyurethane froth foam in a "two-component" polyurethane foam. Because the reactions are different, the dispensing of the chemicals for a two-component polyurethane foam involves different and additional concepts and concerns than that present in the dispensing apparatus for a "one-component" polyurethane froth foam.

A "one-component" foam generally means that both the resin and the isocyanate used in the foam formulation are supplied in a single pressurized container and dispensed from the container through a valve or a gun attached to the container. When the chemicals leave the valve, a reaction with moisture in the air produces a polyurethane froth or foam. Thus, the design concerns related to an apparatus for dispensing one-component polyurethane foam essentially concerns the operating characteristics of how the one-component polyurethane foam is throttled or metered from the pressurized container. While one-component guns can variably meter the polyurethane froth, they are typically used in caulk/glue applications where an adhesive or caulk bead is determined by the nozzle configuration. Post drip is a major concern in such applications as well as the dispensing gun not clogging because of reaction of the one component formulation with air (moisture) within the gun. To address or at least partially address such problems, a needle valve seat is typically applied as close to the dispensing point by a metering rod arrangement which can be pulled back for cleaning. While metering can occur at the needle valve seat, the seat is primarily for shut-off to prevent post drip; and depending on gun dimensioning, metering may principally occur at the gun opening.

In contrast, a "two-component" froth foam means that one principal foam component is supplied in one pressurized container, typically the "A" container (i.e., polymeric isocyanate, fluorocarbons, etc.) while the other principal foam component is supplied in a second pressurized container, typically the "B" container (i.e., polyols, catalysts, flame retardants, fluorocarbons, etc.).

In a two-component polyurethane foam, the "A" and "B" components form the foam or froth, when they are mixed in the dispensing apparatus. Of course, chemical reactions with moisture in the air will also occur with a two-component polyurethane foam after dispensing, but the principal reaction forming the polyurethane foam occurs when the "A" and "B" components are mixed, or contact one another in the dispensing gun. The dispensing apparatus for a two-component polyurethane foam application has to thus address not only the metering design concerns present in a one-component dispensing apparatus, but also the mixing requirements of a two-component polyurethane foam.

Further, a "frothing" characteristic of the foam (foam assumes consistency resembling shaving cream) is enhanced by the fluorocarbon (or similar) component, which is present in the "A" and "B" components. This fluorocarbon component is a compressed gas which exits in its liquid state under pressure and changes to it gaseous state when the liquid is dispensed into a lower pressure ambient environment, such as when the liquid components exit the gun and enter the nozzle.

While polyurethane foam is well known, the formulation varies considerably depending on application. In particular, while the polyols and isocyanates are typically kept separate in the "B" and "A" containers, other chemicals in the formulation may be placed in either container with the result that the weight or viscosity of the liquids in each container varies as well as the ratios at which the "A" and "B" components are to be mixed. In the dispensing gun applications which relate to this invention, the "A" and "B" formulations are such that the mixing ratios are generally kept equal so that the "A" and "B" containers are the same size. However, the weight, more importantly the viscosity, of the liquids in the containers invariably vary from one another. To adjust for viscosity variation between "A" and "B" chemical formulations, the "A" and "B" containers are charged (typically with an inert gas,) at different pressures to achieve equal flow rates. The metering valves in a two-component gun, therefore, have to meter different liquids at different pressures at a precise ratio under varying flow rates. For this reason (among others), some dispensing guns have a design where each metering rod/valve is separately adjustable against a separate spring to compensate not only for ratio variations in different formulations but also viscosity variations between the components. The typical two-component dispensing gun in use today can be viewed as two separate one-component dispensing guns in a common housing discharging their components into a mixing chamber or nozzle. In practice, often the gun operator adjusts the ratio settings to improve gun "performance" with poor results. To counteract this adverse result, the ratio adjustment then has to be "hidden" within the gun, or the design has to be such that the ratio setting is "fixed" in the gun for specific formulations. The gun cost is increased in either event and "fixing" the ratio setting to a specific formulation prevents interchangeability of the dispensing gun.

Besides the ratio control which distinguishes two-component dispensing guns from one-component dispensing guns, a concern which affects all two-component gun designs (not present in one-component dispensing guns) is known in the trade as "cross-over". Generally, "cross-over" means that one of the components of the foam ("A" or "B") has crossed over into the dispensing mechanism in the dispensing gun for the other component ("B" or "A"). Cross-over may occur when the pressure variation between the "A" and "B" cylinders becomes significant. Variation can become significant when the foam formulation initially calls for the "A" and "B" containers to be at high differential charge pressures and the containers have discharged a majority of their components. The containers are accumulators which inherently vary the pressure as the contents of the container are used. To overcome this problem, it is known to equip the guns with conventional one-way valves, such as a poppet valve (or other similarly acting device). While necessary, the dispensing gun's cost is increased.

Somewhat related to cross-over and affecting the operation of a two-component gun is the design of the nozzle. The nozzle is a throw away item detachably mounted to the gun nose. Nozzle design is important for cross-over and metering considerations in that the nozzle directs the "A" and "B" components to a static mixer in the gun.

A still further characteristic distinguishing two-component from one-component gun designs resides in the clogging tendencies of two-component guns. Because the foam foaming reaction commences when the "A" and "B" components contact one another, it is clear that, once the gun is used, the static mixer will clog with polyurethane foam or froth formed within the mixer. This is why the nozzles, which contain the static mixer, are designed as throw away items. In practice, the foam does not instantaneously form within the nozzle upon cessation of metering to the point where the nozzles have to be discarded. Some time must elapse. This is a function of the formulation itself, the design of the static mixer and, all things being equal, the design of the nozzle.

The dispensing gun of the present invention is particularly suited for use in two-component polyurethane foam "kits" typically sold to the building or construction trade. In one instance, the kit contains two pressurized "A" and "B" cylinders of about 7.5 inches in diameter which are pressurized anywhere between 130-250 psi, a pair of hoses for connection to the cylinders and a dispensing gun, all of which are packaged in a container constructed to house and carry the components to the site where the foam is to be applied. When the chemicals in the "A" and "B" containers are depleted, the kit is sometimes discarded or the containers can be recycled. The dispensing gun may or may not be replaced. Since the dispensing gun is included in the kit, kit cost considerations dictate that the dispensing gun be relatively inexpensive. Typically, the dispensing gun is made from plastic with minimal usage of machined parts.

The dispensing guns cited and to which this invention relates are additionally characterized and distinguished from other types of multi-component dispensing guns in that they are, "airless" and typically do not contain provisions for cleaning the gun. That is, a number of dispensing or metering guns or apparatus, particularly those used in high volume foam applications, are equipped or provided with a means or mechanism to introduce air or a solvent for cleaning or clearing the passages in the gun. The use of the term "airless" as used in this patent and the claims hereof means that the dispensing apparatus is not provided with an external, cleaning or purging mechanism.

While the two-component dispensing guns discussed above function in a commercially acceptable manner, it is becoming increasingly clear as the number of in-situ applications for polyurethane foam increase, that the range or the ability of the dispensing gun to function for all such applications has to be improved. As a general example, the dispensing gun design has to be able to throttle or meter a fine bead of polyurethane froth in a sealant application where the kit is sold to seal spaces around window frames, door frames, and the like in the building trade. In contrast, where the kit is sold to form insulation, an ability to meter or flow a high volume flow of chemicals is required. Still yet, in an adhesive application, liquid spray patterns of various widths and thickness are required. While the "A" and "B" components for each of these applications are specially formulated and differ from one another, one dispensing gun for all such applications involving different formulations of the chemicals is needed.

At least one recurring quality issue facing the disposable polyurethane foam kit industry is the inability of end-users to effectively assess the core chemical temperature of the liquid and gas contents contained therein. Two important functions are often negatively impacted: achievement of maximum foam kit yield on the job site, and proper chemical cure of the "A" & "B" components.

Maximum yield is highly desired by purchasers of polyurethane foam kit products. If the chemicals are too cold for optimum use, the "B"-side viscosity increases, which in turn distorts the 1:1 ratio (by weight) required for proper yield. Lower-than-advertised yields carry significant economical consequences for the contractor.

Proper chemical cure (on-ratio ~1:1) is also critical to achieving maximum physical properties. It ensures that the cured foam meets building code specifications, e.g. fire ratings. In addition, a complete, on-ratio cure is critical for the health and safety of foam kit operators and building occupants. Again, cold chemical temperatures (below recommended) can create off-ratio foam, with the resulting incomplete chemical cure.

At least one important variable impacting the above issues is the core chemical temperature of the liquid/gas contents of the foam kit. The core chemical temperature of a kit before use must meet the manufacturer's recommended temperature, usually ~75° F.-85° F., in order to meet the objectives of maximum yield and proper (complete) chemical cure. However, end-users typically do not condition the kits long enough at the recommended temperature. For example, kits stored in an unconditioned warehouse or insulation truck in the winter months may have a core chemical temperature of only ~40° F. If dispensed without being conditioned for a sufficient amount of time, the result is foam of very poor physical quality and appearance. Also, improper chemical cure will most likely occur (unbalanced ratio of "A" to "B" chemical, which is typically 1:1 by weight). This "off-ratio" foam becomes a liability for the reasons mentioned above. It can take up to 48 hours to condition cylinders to the recommended chemical temperature, a recommendation often ignored by end-users.

The industry has long searched for an effective, economical way to allow end-users to gauge the core chemical temperature of a kit with a reasonable degree of qualitative accuracy before applying the foam. This invention utilizes thermochromism in both the nozzle and the hoses associated with the "A" and "B" chemicals to determine when the temperature of the chemicals falls within the acceptable use range, based upon the color change of the nozzle or hose due to a change in temperature of the flowing chemical.

SUMMARY OF THE INVENTION

The present invention is directed to a spray tip nozzle for the non-longitudinally axially spraying of aerosols which the nozzle of which includes: an expanded nozzle housing at a distal end for affixing to a mating housing of a spray gun; an elongated body having a mixing chamber adjacent and in fluid communication with the expanded nozzle housing; a nozzle tip at a proximal end of the housing in fluid communication with the mixing chamber, the nozzle tip having an egress opening; a lateral deflecting means which diverts longitudinally axial aerosol droplets to non-longitudinally axial egress; and an attachment means to affixing the nozzle to a spray gun at the expanded nozzle housing.

In one aspect of the invention, the lateral deflecting means is a pair of lips angled off-axis to a longitudinal axis of the elongated body of the nozzle and adjacent the egress opening of the nozzle. The off-axis lips typically form a V-shape, the upper lip forming an angle $\alpha$ to the longitudinal axis of the elongated body of the nozzle; the lower lip forming an angle $\beta$ to the elongated body of the nozzle; and further wherein angle $\alpha$ is always smaller than angle $\beta$. Angle $\alpha$ ranges from 5° to 45° inclusive; and angle $\beta$ ranges from 10° to 90° inclusive; with the proviso that angle $\beta$ is always at least 5° greater than angle $\alpha$. More preferably, angle $\beta$ is always at least 10° greater than angle $\alpha$, often angle $\beta$ is always at least 25° greater than angle $\alpha$, and often angle $\beta$ is always at least 40° greater than angle $\alpha$.

For attachment to the main body of a spray gun, the attaching means will include a resiliently biased finger having a protruding lip for affixing to a mating depression on the spray gun. In some aspects of the invention, the spray tip nozzle is a color-changing tip.

The non-lateral spray pattern is not limited to the configuration described above, rather the lateral deflecting means can be an opening in a side wall of the spray nozzle tip. When the nozzle tip is beveled, the opening may be at least partially within the bevel of the tip. As previously, the nozzle tip may be a color-changing tip with a similar attachment mechanism to the main body of the spray gun.

In yet another embodiment of the invention, the lateral deflecting means is a peripherally deflecting wall post egress tip nozzle opening. In one aspect, the deflecting wall is curvilinear; and the egress opening is positioned collinearly with the longitudinal axis of the elongated body of the nozzle. As discussed previously, the nozzle tip may be a color-changing tip with a similar attachment mechanism to the main body of the spray gun.

In still yet another embodiment of the invention, the lateral deflecting means is a non-parallel mirror image pair of divergent lips with color-changing aspects and similar attachment mechanism.

The plastic nozzle tip is a thermoplastic or thermoset polymer.

These and other objects of this invention will be evident when viewed in light of the drawings, detailed description and appended claims.

DETAILED DESCRIPTION OF THE INVENTION

The best mode for carrying out the invention will now be described for the purposes of illustrating the best mode known to the applicant at the time of the filing of this invention. The examples and figures are illustrative only and not meant to limit the invention, as measured by the scope and spirit of the claims.

Unless the context clearly indicates otherwise: the word "and" indicates the conjunctive; the word "or" indicates the disjunctive; when the article is phrased in the disjunctive, followed by the words "or both" or "combinations thereof" both the conjunctive and disjunctive are intended.

As used in this application, the term "approximately" is within 10% of the stated value, except where noted.

As used in this application, the term "non-linear spray pattern" means a spray pattern which has been applied using a tip in which the aerosol particles and/or droplets emanate from the spray tip through an egress opening in the tip which imparts a degree of angularity to the spray pattern compared to a spray pattern in which the egress opening in the tip is collinear with the longitudinal axis of the tip.

Figure 1:
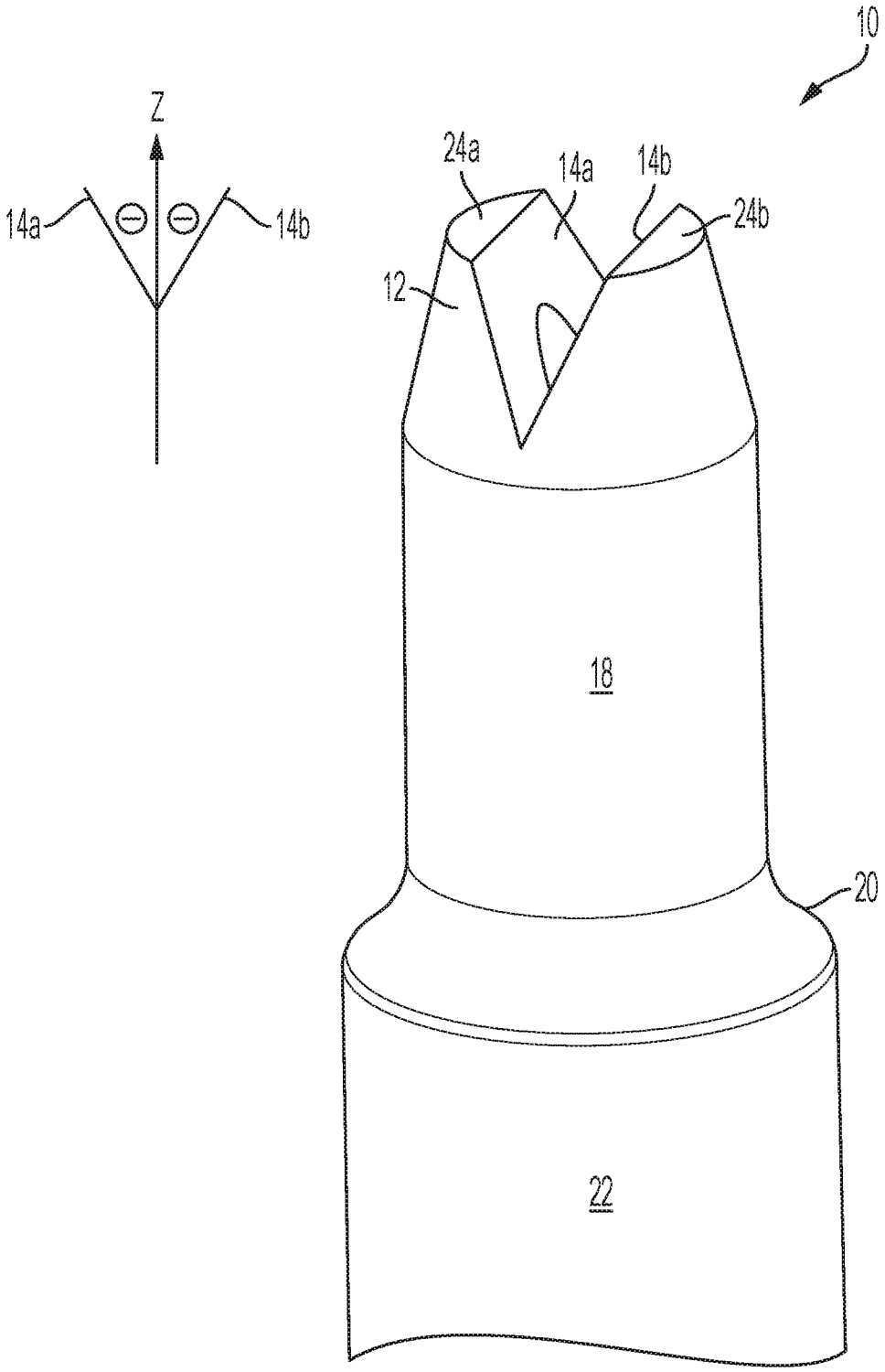
FIG. 1 PRIOR ART
FIG. 1 is perspective view of a V-shaped Prior Art fan nozzle in which the spray pattern is directed along the longitudinal axis of the nozzle.

As shown in FIG. 1, a typical Prior Art spray tip 10 has egress of aerosol particles and/or droplets and/or froth foam along a longitudinal axis of the nozzle. The nozzle has an axial opening 12 which is collinear with the nozzle body longitudinal axis. Spray tip 10 generally has a flat pair of opposed terminal lateral surfaces 24*a*, 24*b*. Nozzle tip 16 expands radially from the pair of terminal lateral surfaces to static nozzle body 18. V-shaped notch, as measured in the "Z"-plane, creates a pair of divergent lips in the tip nozzle body. The angle created by V-shaped lips 14*a*, 14*b* may vary depending upon the application to which the nozzle is to be put, but the spray pattern is still generally along the longitudinal axis of the body of the nozzle, due at least in part to the fact that axial opening 12 is collinear with the nozzle body longitudinal axis and opposed terminal lateral surfaces 24*a*, 24*b* are not impeding the flow of aerosol droplets upon egress from the nozzle. The on-axis spray pattern is employed by having the V-shaped lips 14*a*, 14*b* being angled at approximately the same angle θ as formed by either lip 14*a* or 14*b* and the longitudinal axis "Z". Tip nozzle body 18 expands into hollow nozzle body 22 through collar 20.

Figure 2:
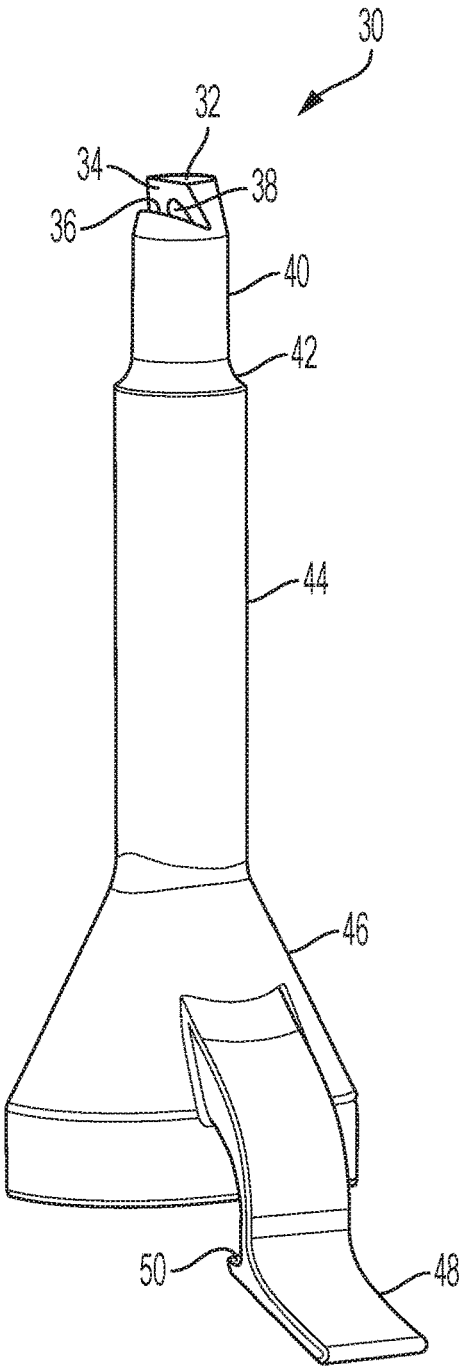
FIG. 2 is perspective view of a nozzle in which the spray pattern of the aerosol droplets is directed at an angle to the longitudinal axis of the nozzle.
Figure 3:
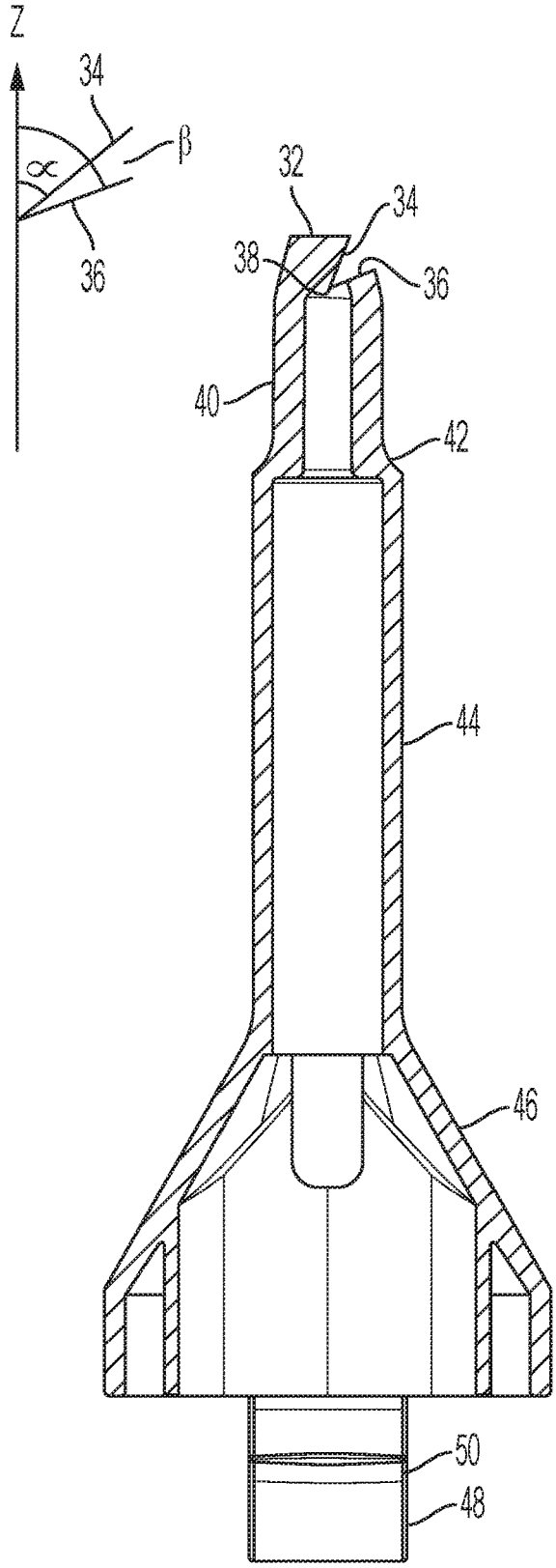
FIG. 3 is a cross-sectional view of FIG. 2.
Figure 4:
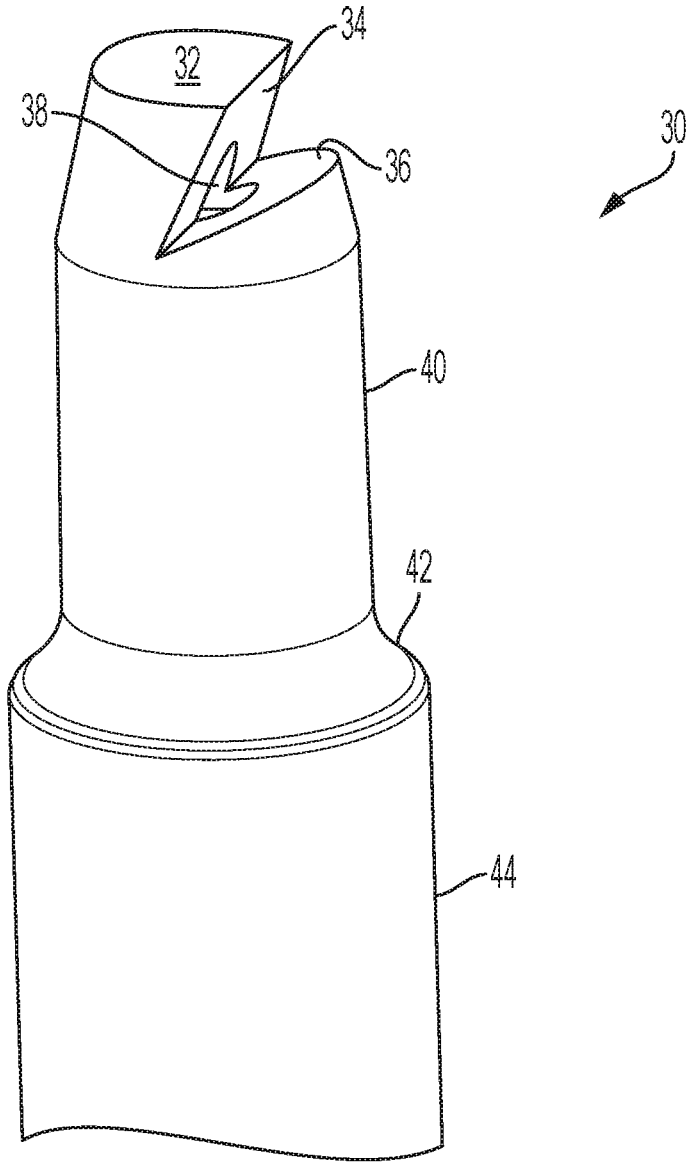
FIG. 4 is an enlarged depiction of FIG. 2.

As better illustrated in FIGS. 2-4, one embodiment of nozzle 30 employs at least one lip 34 which is a deflector means. Deflection of aerosol particles or droplets is achieved by the lips being angled off-axis to the longitudinal Z-axis of the body of the nozzle. This off-axis aspect of the invention is achieved in this embodiment by employing a terminal lateral surface 32 in which at least a portion of the lateral surface covers at least a part of the egress axial opening 38 in combination with the two V-shaped lips being cut at angles to the longitudinal axis as illustrated by angles "α" and "β" wherein angle α is always smaller than angle β. Angle α, as defined by the intersection of upper lip 34 with the longitudinal axis of the nozzle, the "Z" ordinate ranges from 5° to 45° inclusive and angle β, as defined by the intersection of lower lip 36 and the "z" ordinate ranges from 10° to 90° inclusive with the proviso that angle β is always at least 5° greater than angle α, preferably at least 10° greater than angle α, more preferably at least 25° greater than angle α, and preferably at least 40° greater than angle α. It is recognized that the larger the difference between the respective angles, the larger the egress flow permitted through egress opening 38.

Continuing with reference to FIG. 2, nozzle terminal lateral surface 32 will be a majority of the area of the tip as compared to a circle into which upper lip 34 had not been cut. This is contrasted with terminal lateral surfaces 24*a*, 24*b* of FIG. 1 in which a pair of lateral surfaces are defined by angle θ. Post nozzle tip 40 is static mixer body 44 with collar 42 interposed. Static mixer body 44 terminates with expanded connecting collar 46 for affixing to a mating male insertion with resiliently biased finger 48 having a fastening lip positioned for grasping and latching onto a mating recess on the front portion of the housing of the spray gun (not shown).

Figure 5:
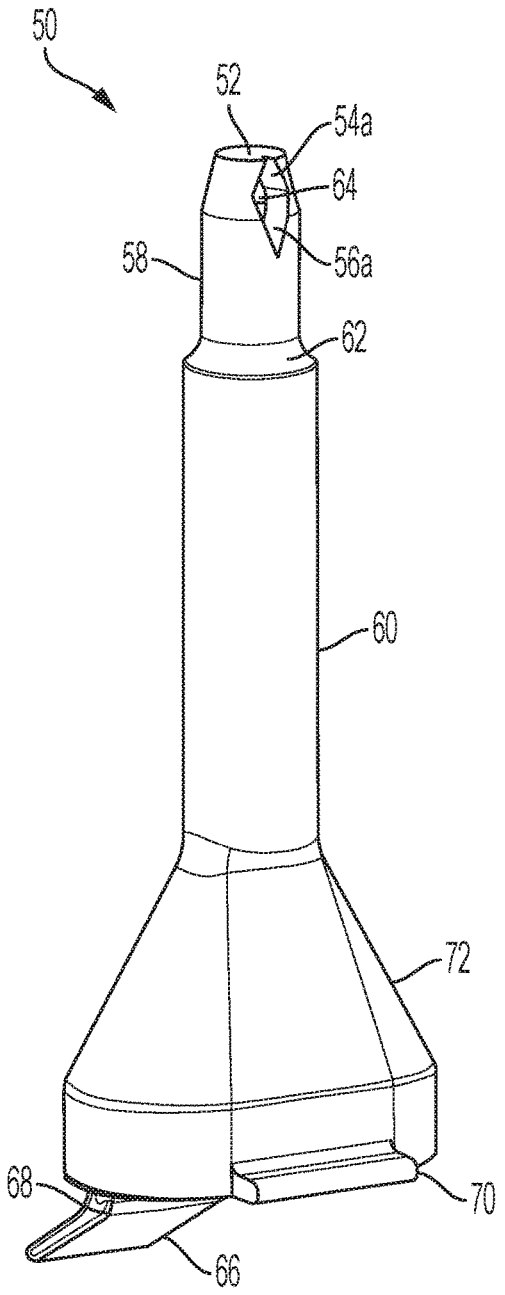
FIG. 5 is an alternate embodiment of a nozzle in which the spray pattern of the aerosol droplets is directed at an angle to the longitudinal axis of the nozzle.
Figure 6:
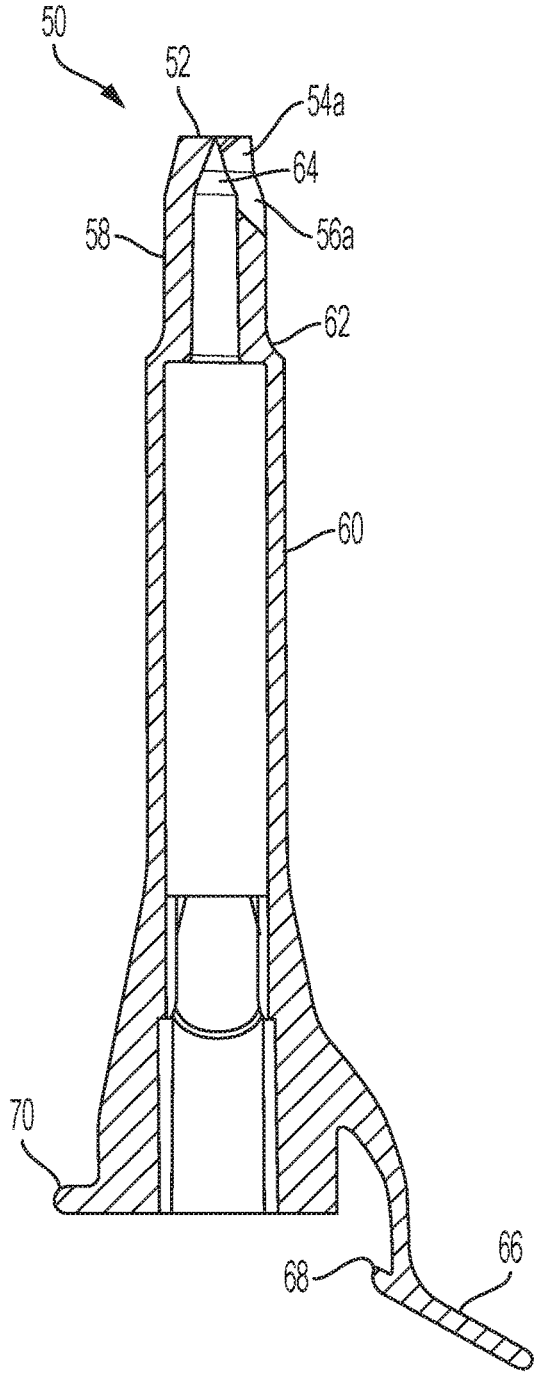
FIG. 6 is a cross-sectional view of FIG. 5.
Figure 7:
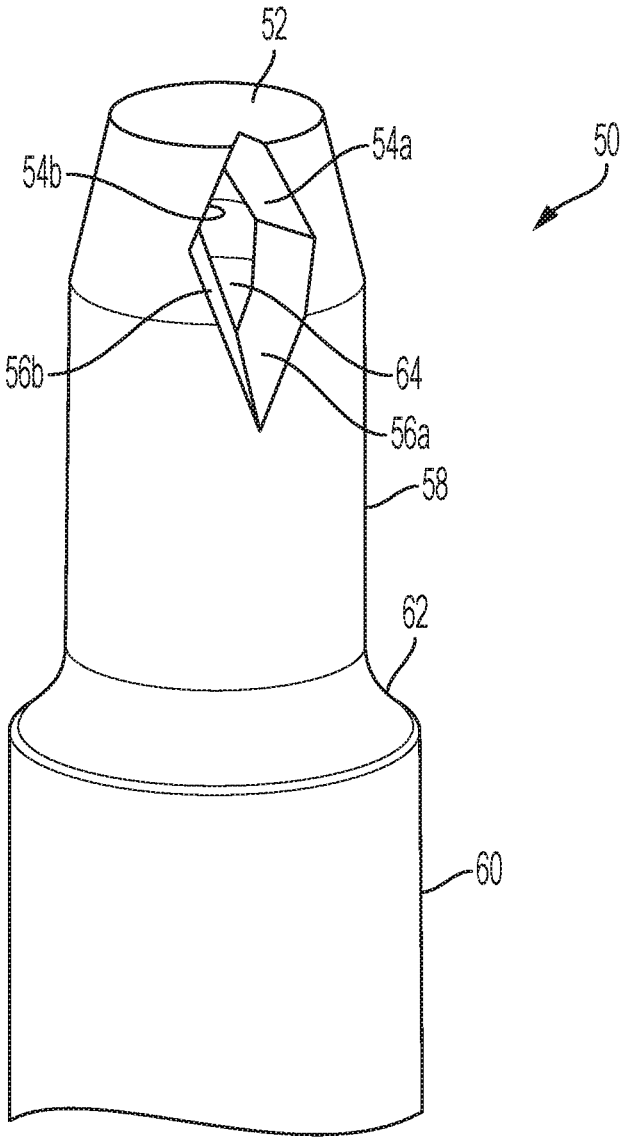
FIG. 7 is an enlarged depiction of FIG. 5.

As better illustrated with reference to FIGS. 5-7, another embodiment of a non-linear spray pattern nozzle 50 is shown. In this embodiment, the non-linear spray pattern is achieved by the creation of an egress opening 64 in the beveled nozzle tip 58 having a terminal lateral surface 52, the majority of the area of the lateral tip surface area being circular, and in some instances, completely circular. Opening 64 is essentially positioned at 90° to the longitudinal axis of the nozzle. While the opening is illustrated as diamond or trapezoid shaped, in one aspect of the invention, the opening is circular. When egress opening 64 is a geometric shape other than circular, walls 54*a*, 54*b*, 56*a*, 56*b* are positioned in a side wall of beveled nozzle tip 58. As discussed previously with respect to FIGS. 2-4, the nozzle illustrated in FIGS. 5-7 will have a beveled nozzle tip in communication with a static mixer connected via collar 62. Static mixer body 60 terminates with expanded connecting collar 72 for affixing to a mating male insertion with resiliently biased finger 66 having a fastening lip 68 positioned for grasping and latching onto a mating recess on the front portion of the housing of the spray gun (not shown). In one embodiment, spray tip 50 will have a male projection 70 for mating with a female opening on the housing of the spray gun (not shown).

Figure 8:
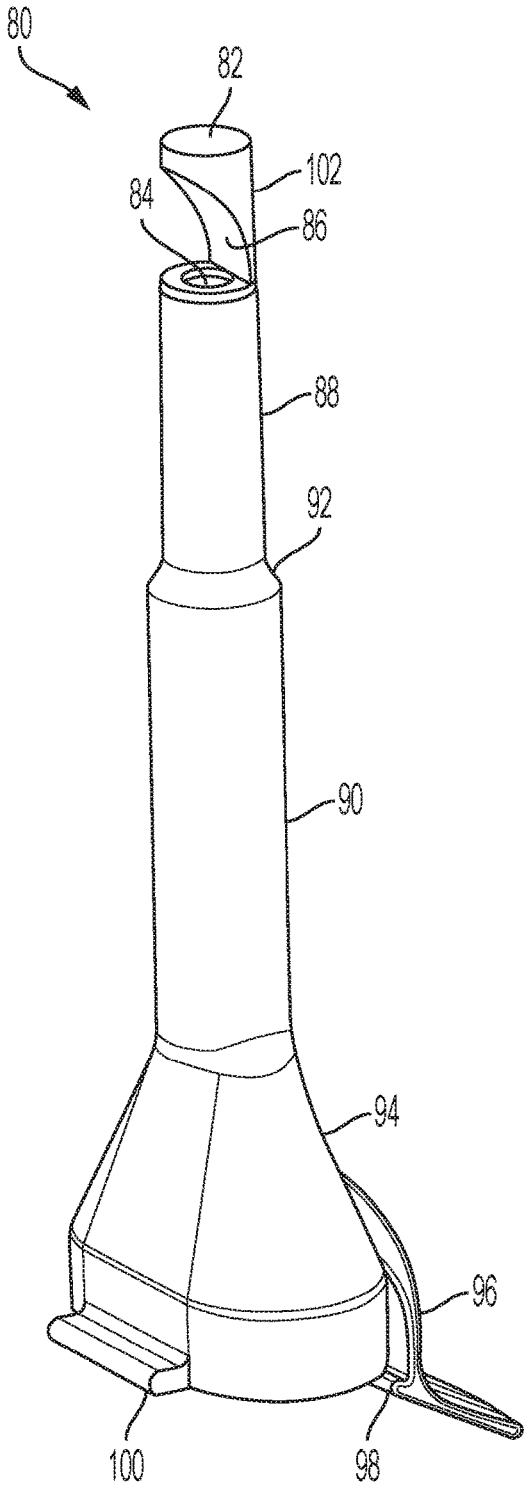
FIG. 8 is another alternate embodiment of a nozzle in which the spray pattern of the aerosol droplets is directed at an angle to the longitudinal axis of the nozzle.
Figure 9:
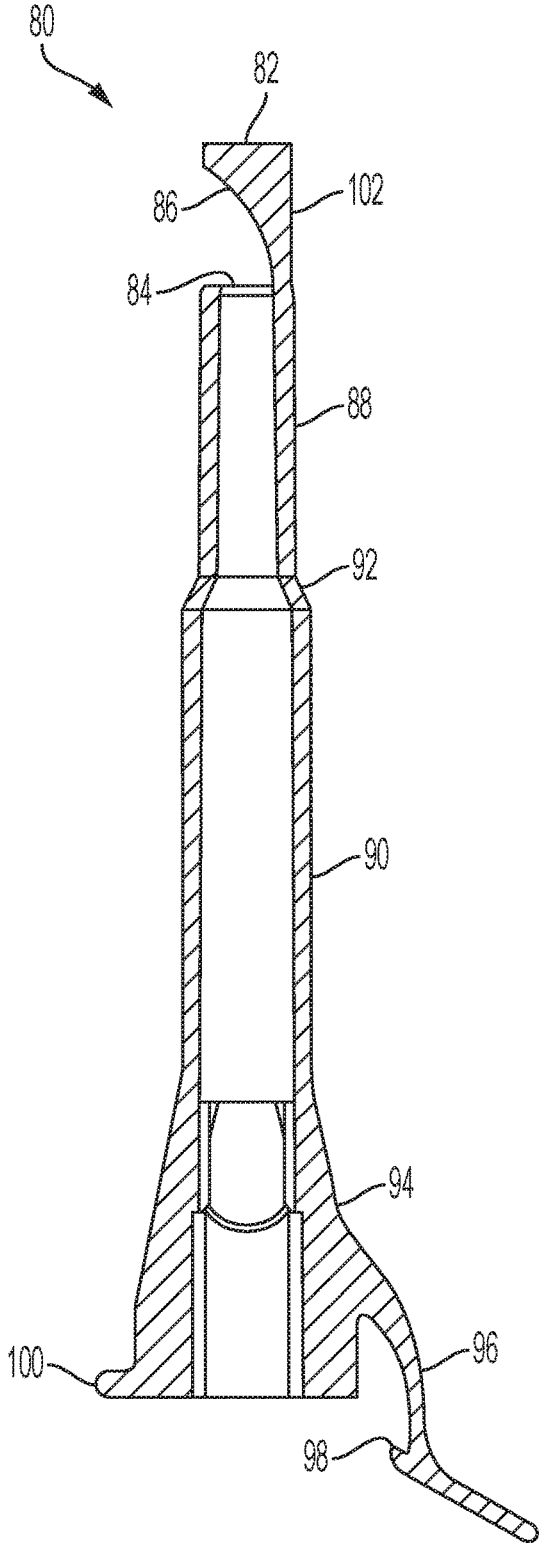
FIG. 9 is a cross-sectional view of FIG. 8.
Figure 10:
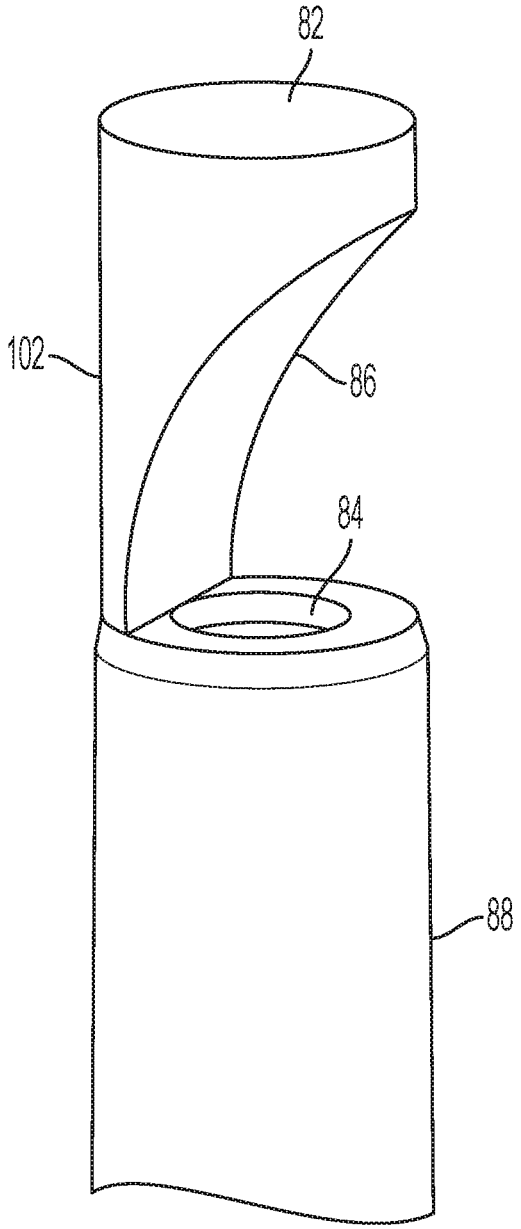
FIG. 10 is an enlarged depiction of FIG. 8.

Another embodiment of a non-linear spray pattern nozzle 80 of the invention is illustrated in FIGS. 8-10. In this embodiment, the non-linear spray pattern is achieved by the creation of a circular egress opening 84 in nozzle tip 102 having an upwardly extending curvilinear deflecting wall 86 extending about at least a portion of egress opening 84, and terminating in a terminal lateral surface 82, the majority of the area of the lateral surface of the tip being circular, and in some instances, completely circular. In some applications, upwardly extending curvilinear deflecting wall 86 will extend into terminal lateral surface 82. Opening 84 is essentially positioned collinearly with the longitudinal axis of the nozzle. As discussed previously with respect to FIGS. 2-7, the nozzle illustrated in FIGS. 8-10 will have a nozzle tip in communication with a static mixer connected via collar 92. Static mixer body 90 terminates with expanded connecting collar 94 for affixing to a mating male insertion with resiliently biased finger 96 having a fastening lip 98 positioned for grasping and latching onto a mating recess on the front portion of the housing of the spray gun (not shown). In one embodiment, spray tip 80 will have a male projection 100 for mating with a female opening on the housing of the spray gun (not shown).

Figure 11:
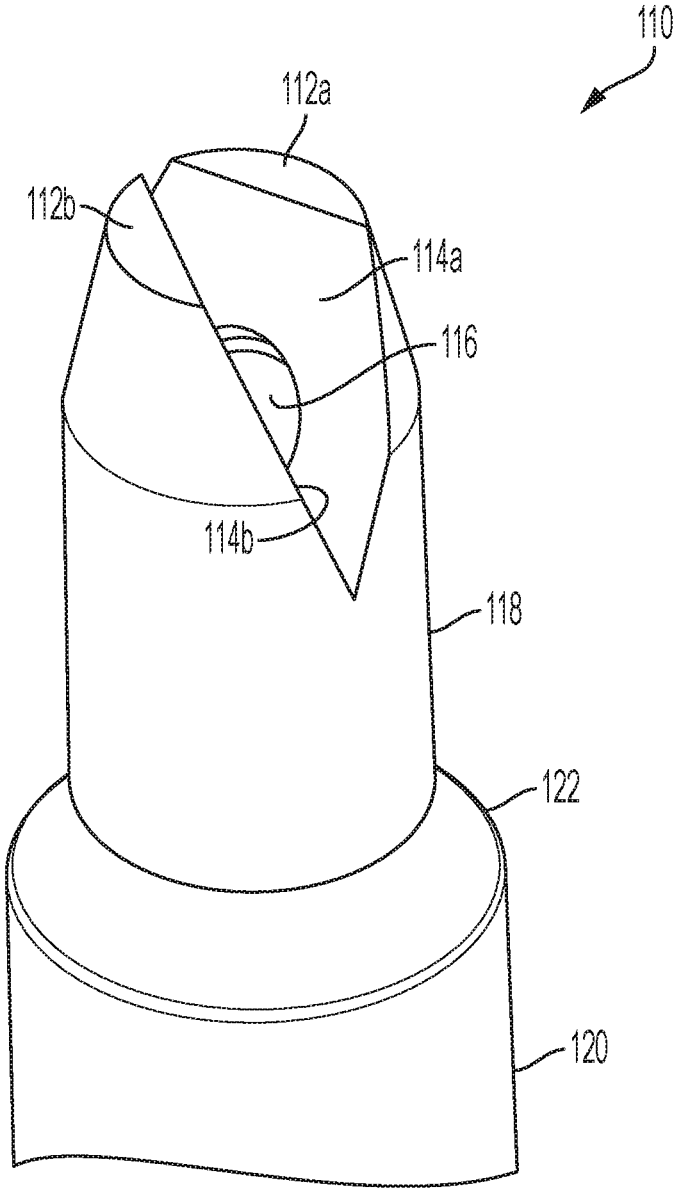
FIG. 11 is another alternate embodiment of a nozzle in which the spray pattern of the aerosol droplets is directed at an angle to the longitudinal axis of the nozzle.
Figure 12:
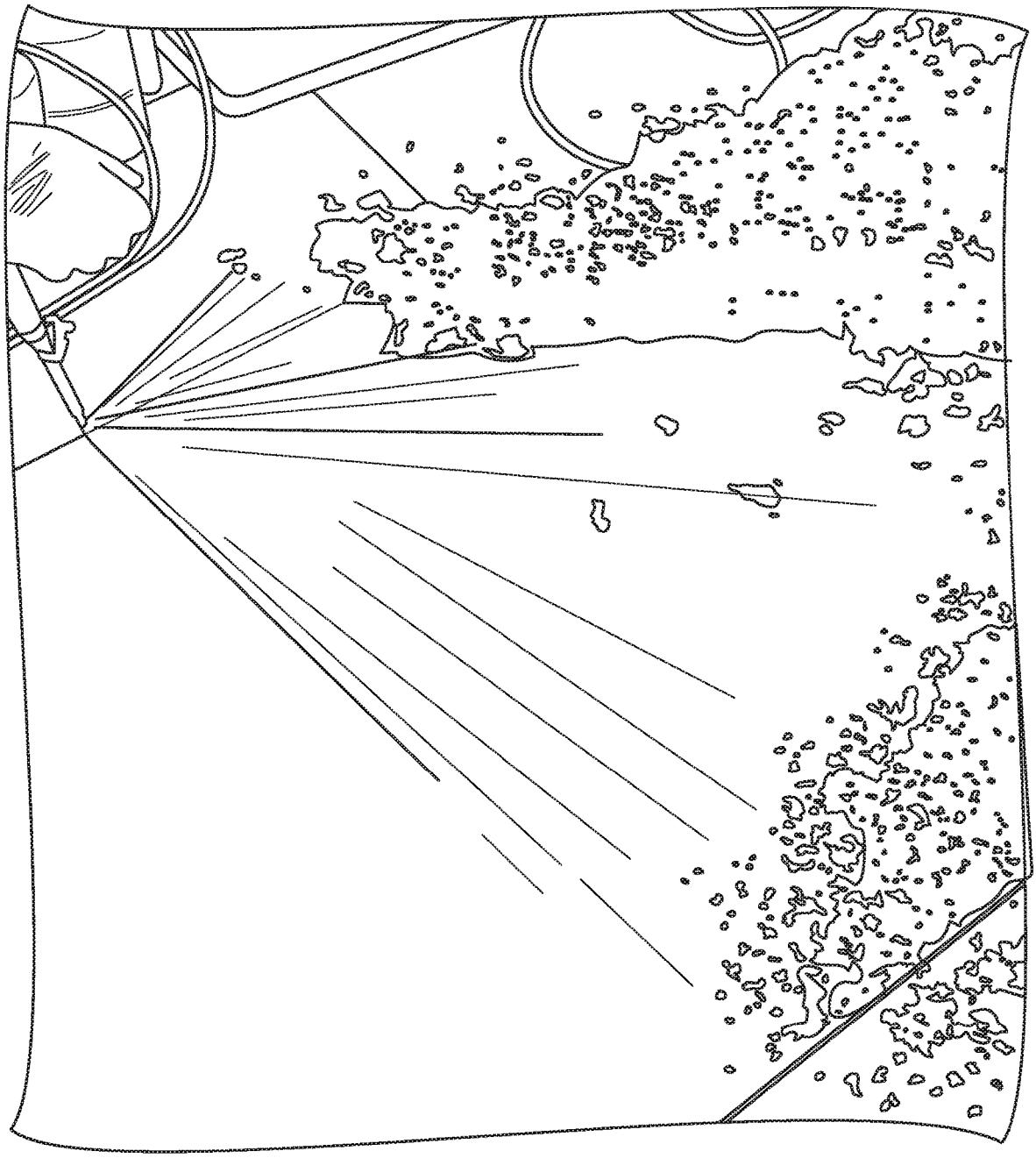
FIG. 12 is a depiction of an example of the spray pattern of the nozzle of FIG. 8.
Figure 13:
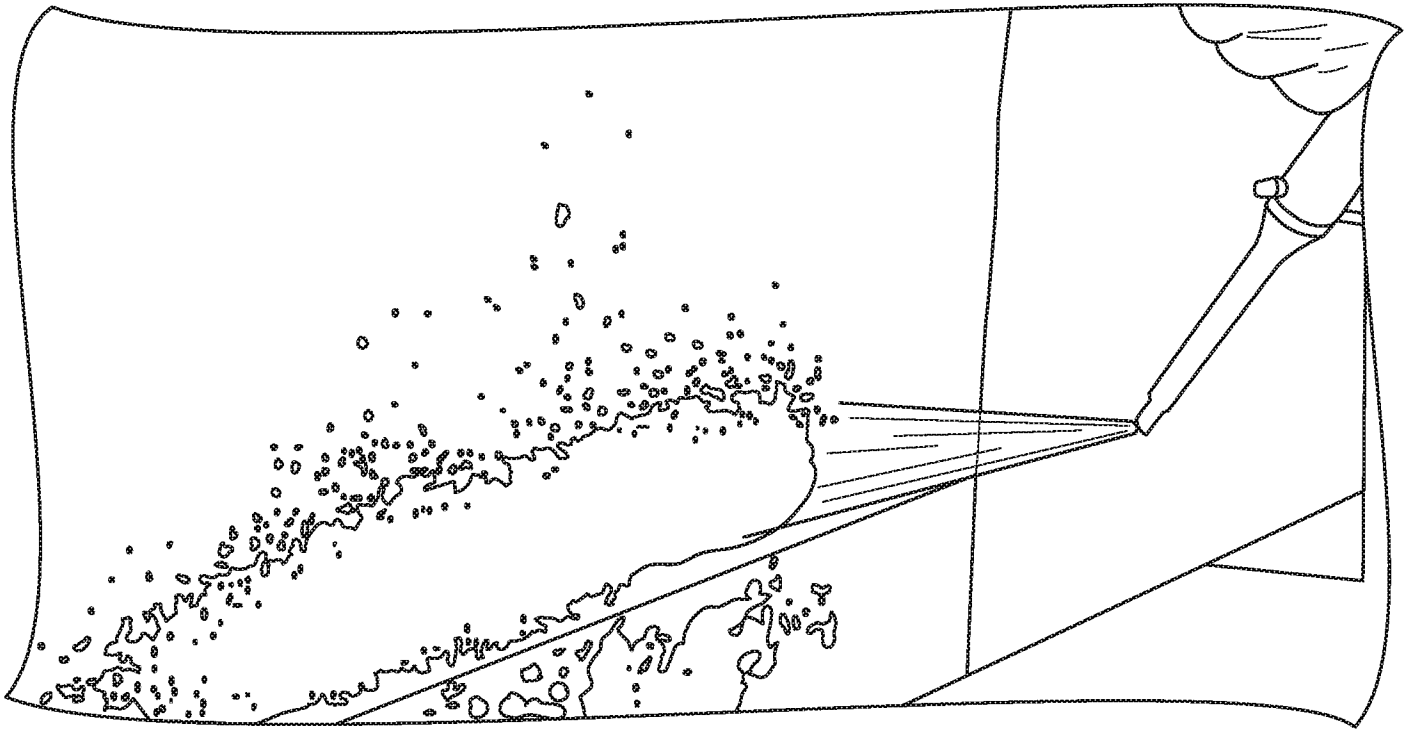
FIG. 13 is a depiction of an example of the spray pattern of the nozzle of FIG. 2.
Figure 14:
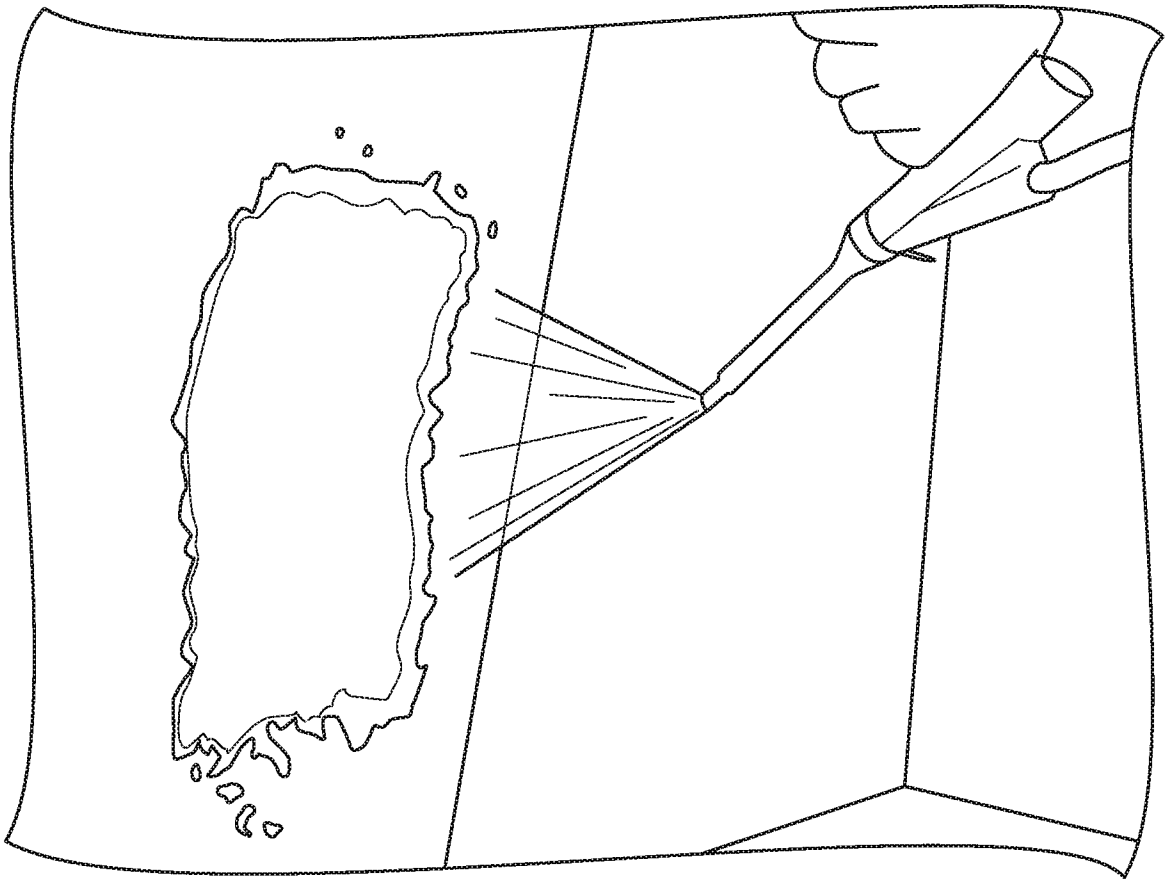
FIG. 14 is a depiction of an example of the spray pattern of the nozzle of FIG. 11.
Figure 15:
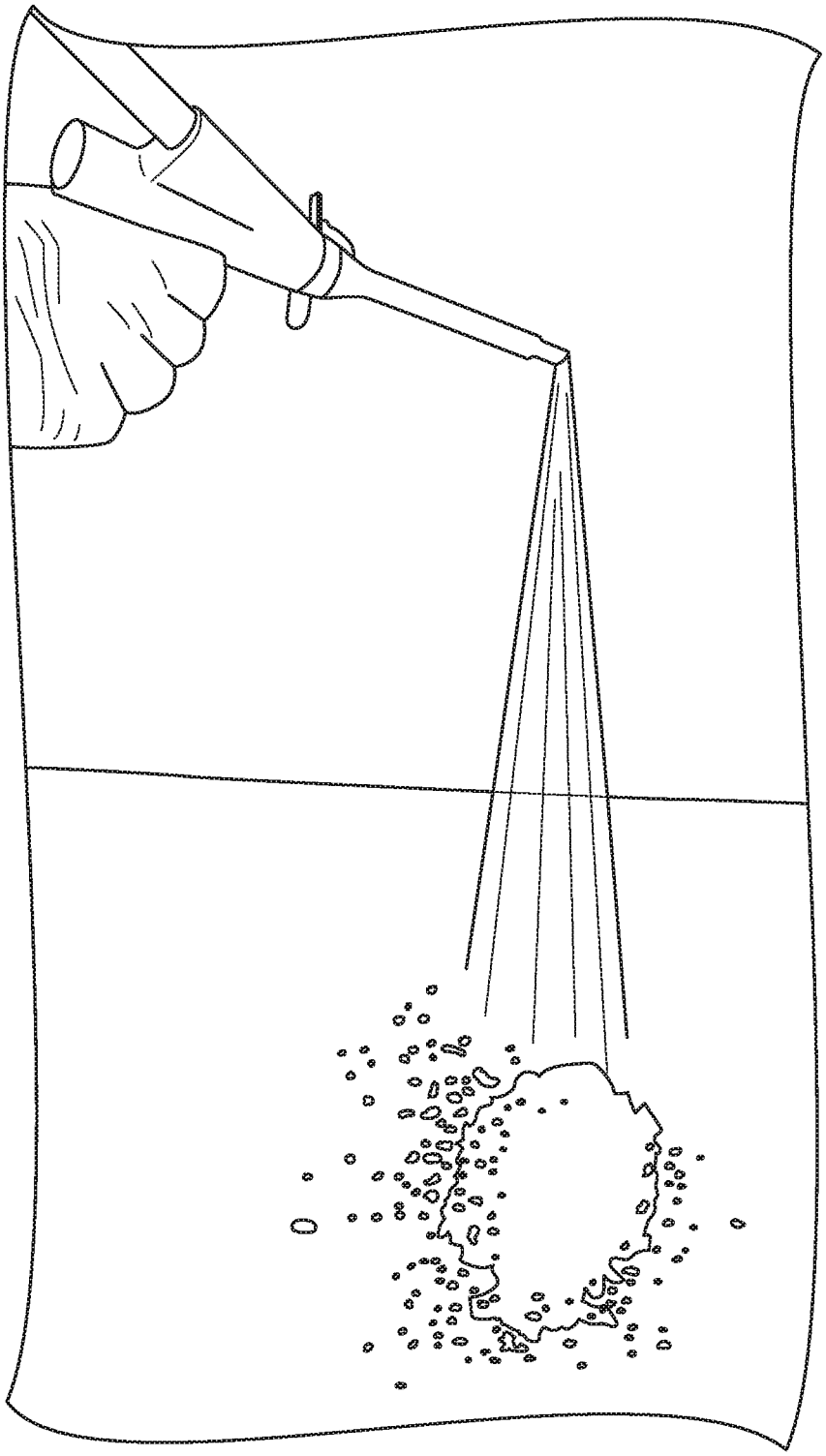
FIG. 15 is a depiction of an example of the spray pattern of the nozzle of FIG. 5.

As further illustrated in FIG. 11 is yet another embodiment of the invention. In this aspect of the invention, the non-linear spray pattern is achieved by the creation of a non-parallel mirror image pair of lips 114*a*, 114*b* along the Z-axis which create a deflecting pattern for circular egress opening 116 in nozzle tip 110 terminating in two essentially mirror image terminal surfaces, 112*a*, 112*b*. Divergent lips 114*a*, 114*b* diverge in the X-Y plane. While opening 116 is essentially positioned collinearly with the longitudinal axis of the nozzle, the non-parallel lips 114*a*, 114*b* create a divergent aerosol path. As discussed previously with respect to FIGS. 2-10, the nozzle illustrated in FIG. 11 will have a nozzle tip in communication with a static mixer body 120 connected via collar 122.

As illustrated in FIGS. 12-15, an exemplary non-linear spray pattern is achieved using the nozzles of the invention, thereby enabling an end-user to be able to spray foam into hard-to-reach locations, particularly between ceiling joists where a lower wall impairs either sight lines or physical access.

In each of the above embodiments, a deflecting means is employed which creates the non-axial longitudinal spray pattern. In FIGS. 2-4, the deflecting means is the combination of a pair of lips each having a different angle of intersection with the "Z" longitudinal axis of the nozzle. In FIGS. 5-7, the deflecting means is the combination of walls which are cut into the side wall of the nozzle thereby allowing egress of the aerosol particles or droplets to be expelled off-angle from the longitudinal "Z" axis of the nozzle. In FIGS. 8-10, the deflecting means is a curvilinear wall post egress opening of the nozzle, the curvilinear wall being directly in the axial longitudinal path of the nozzle. And finally, in FIG. 11, the deflecting means is a combination of a pair of lips, each of which is a mirror image of the other, but non-parallel to each other.

The spray tip is typically made of a polymer, either a thermoplastic or a thermoset. Low cost is often a factor in the composition of the polymer as the item is a throw-away item. An illustrative non-limiting set of examples of polymers which may be used in the molding of the spray tip include, but are not limited to:

Polymers of monoolefins and diolefins for example polypropylene, polyisobutylene, polybut-1-ene, poly-4-methylpent-1-ene, polyvinylcyclohexane, polyisoprene or polybutadiene, as well as polymers of cycloolefins, for instance of cyclopentene or norbornene, polyethylene (which optionally can be crosslinked), for example high density polyethylene (HDPE), high density and high molecular weight polyethylene (HDPE-HMW), high density and ultrahigh molecular weight polyethylene (HDPE-UHMW), medium density polyethylene (MDPE), low density polyethylene (LDPE), linear low density polyethylene (LLDPE), (VLDPE) and (ULDPE), and blends of the polymers described above, regardless of the method of preparation. Mixtures of the polymers above are also included, for example, mixtures of polypropylene with polyisobutylene, polypropylene with polyethylene (for example PP/HDPE, PP/LDPE) and mixtures of different types of polyethylene (for example LDPE/HDPE). Copolymers of monoolefins and diolefins with each other or with other vinyl monomers such as ethylene/propylene copolymers, linear low density polyethylene (LLDPE) and mixtures thereof with low density polyethylene (LDPE), propylene/but-1-ene copolymers, propylene/isobutylene copolymers, ethylene/but-1-ene copolymers, ethylene/hexene copolymers, ethylene/methylpentene copolymers, ethylene/heptene copolymers, ethylene/octene copolymers, ethylene/vinylcyclohexane copolymers, ethylene/cycloolefin copolymers (e.g. ethylene/norbornene like COC), ethylene/1-olefins copolymers, where the 1-olefin is generated in-situ; propylene/butadiene copolymers, isobutylene/isoprene copolymers, ethylene/vinylcyclohexene copolymers, ethylene/alkyl acrylate copolymers, ethylene/alkyl methacrylate copolymers, ethylene/vinyl acetate copolymers or ethylene/acrylic acid copolymers and their salts (ionomers) as well as terpolymers of ethylene with propylene and a diene such as hexadiene, dicyclopentadiene or ethylidene-norbornene; and mixtures of such copolymers with one another and with polymers mentioned previously, for example polypropylene/ethylene-propylene copolymers, LDPE/ethylene-vinyl acetate copolymers (EVA), LDPE/ethylene-acrylic acid copolymers (EAA), LLDPE/EVA, LLDPE/EAA and alternating or random polyalkylene/carbon monoxide copolymers and mixtures thereof with other polymers, for example polyamides.

Polystyrene and poly(p-methylstyrene) and poly(α-methylstyene). Aromatic homopolymers and copolymers derived from vinyl aromatic monomers including styrene, α-methylstyrene, all isomers of vinyl toluene, especially p-vinyltoluene, all isomers of ethyl styrene, propyl styrene, vinyl biphenyl, vinyl naphthalene, and vinyl anthracene, and mixtures thereof. Homopolymers and copolymers may have any stereostructure including syndiotactic, isotactic, hemi-isotactic or atactic. Stereoblock polymers are also included. Copolymers are included, such as vinyl aromatic monomers and comonomers selected from ethylene, propylene, dienes, nitriles, acids, maleic anhydrides, maleimides, vinyl acetate and vinyl chloride or acrylic derivatives and mixtures thereof, for example styrene/butadiene, styrene/acrylonitrile, styrene/ethylene (interpolymers), styrene/alkyl methacrylate, styrene/butadiene/alkyl acrylate, styrene/butadiene/alkyl methacrylate, styrene/maleic anhydride, styrene/acrylonitrile/methyl acrylate; mixtures of high impact strength of styrene copolymers and another polymer, for example a polyacrylate, a diene polymer or an ethylene/propylene/diene terpolymer; and block copolymers of styrene such as styrene/butadiene/styrene, styrene/isoprene/styrene, styrene/ethylene/butylene/styrene or styrene/ethylene/propylene/styrene. Hydrogenated aromatic polymers derived from hydrogenation of polymers mentioned above are included, especially including polycyclohexylethylene (PCHE) prepared by hydrogenating atactic polystyrene, often referred to as polyvinylcyclohexane (PVCH). Further included are hydrogenated aromatic polymers derived from hydrogenation of polymers mentioned previously. The homopolymers and copolymers may have any stereostructure including syndiotactic, isotactic, hemi-isotactic or atactic. Stereoblock polymers are also included. Graft copolymers of vinyl aromatic monomers, such as styrene or α-methylstyrene, for example styrene on polybutadiene, styrene on polybutadiene-styrene or polybutadiene-acrylonitrile copolymers; styrene and acrylonitrile (or methacrylonitrile) on polybutadiene; styrene, acrylonitrile and methyl methacrylate on polybutadiene; styrene and maleic anhydride on polybutadiene; styrene, acrylonitrile and maleic anhydride or maleimide on polybutadiene; styrene and maleimide on polybutadiene; styrene and alkyl acrylates or methacrylates on polybutadiene; styrene and acrylonitrile on ethylene/propylene/diene terpolymers; styrene and acrylonitrile on polyalkyl acrylates or polyalkyl methacrylates, styrene and acrylonitrile on acrylate/butadiene copolymers, as well as mixtures thereof with the copolymers listed above, for example the copolymer mixtures known as ABS, MBS, ASA or AES polymers.

Halogen-containing polymers such as polychloroprene, chlorinated rubbers, chlorinated and brominated copolymer of isobutylene-isoprene (halobutyl rubber), chlorinated or sulfo-chlorinated polyethylene, copolymers of ethylene and chlorinated ethylene, epichlorohydrin homo- and copolymers, especially polymers of halogen-containing vinyl compounds, for example polyvinyl chloride, polyvinylidene chloride, polyvinyl fluoride, polyvinylidene fluoride, as well as copolymers thereof such as vinyl chloride/vinylidene chloride, vinyl chloride/vinyl acetate or vinylidene chloride/vinyl acetate copolymers. such as styrene on polybutadiene, styrene and alkylacrylates or methacrylates on butadiene, styrene and acrylonitrile on ethylene/propylene/diene terpolymers, styrene and acrylonitrile on polyacrylates or polymethacrylates, styrene and acrylonitrile on acrylate/butadiene copolymers, and copolymer blends known as ABS, MBS, and AES polymers.

Polymers derived from α,β-unsaturated acids and derivatives thereof such as polyacrylates and polymethacrylates; polymethyl methacrylates, polyacrylamides and polyacrylonitriles, impact-modified with butyl acrylate. Copolymers of the monomers mentioned in the preceding paragraph with each other or with other unsaturated monomers, for example acrylonitrile/butadiene copolymers, acrylonitrile/alkyl acrylate copolymers, acrylonitrile/alkoxyalkyl acrylate or acrylonitrile/vinyl halide copolymers or acrylonitrile/alkyl methacrylate/butadiene terpolymers.

Polymers derived from unsaturated alcohols and amines or the acyl derivatives or acetals thereof, for example polyvinyl alcohol, polyvinyl acetate, polyvinyl stearate, polyvinyl benzoate, polyvinyl maleate, polyvinyl butyral, polyallyl phthalate or polyallyl melamine; as well as their copolymers with olefins mentioned above.

Homopolymers and copolymers of cyclic ethers such as polyalkylene glycols, polyethylene oxide, polypropylene oxide or copolymers thereof with bisglycidyl ethers. Polyacetals such as polyoxymethylene and those polyoxymethylenes which contain ethylene oxide as a comonomer; polyacetals modified with thermoplastic polyurethanes, acrylates or MBS.

Polyphenylene oxides and sulfides, and mixtures of polyphenylene oxides with styrene polymers or polyamides.

Polyamides and copolyamides derived from diamines and dicarboxylic acids and/or from aminocarboxylic acids or the corresponding lactams, for example polyamide 4, polyamide 6, polyamide 6/6, 6/10, 6/9, 6/12, 4/6, 12/12, polyamide 11, polyamide 12, aromatic polyamides starting from m-xylene diamine and adipic acid; polyamides prepared from hexamethylenediamine and isophthalic or/and terephthalic acid and with or without an elastomer as modifier, for example poly-2,4,4,-trimethylhexamethylene terephthalamide or poly-m-phenylene isophthalamide; and also block copolymers of the aforementioned polyamides with polyolefins, olefin copolymers, ionomers or chemically bonded or grafted elastomers; or with polyethers, e.g. with polyethylene glycol, polypropylene glycol or polytetramethylene glycol; as well as polyamides or copolyamides modified with EPDM or ABS; and polyamides condensed during processing (RIM polyamide systems).

Polyureas, polyimides, polyamide-imides, polyetherimids, polyesterimids, polyhydantoins and polybenzimidazoles.

Polyesters derived from dicarboxylic acids and diols and/or from hydroxycarboxylic acids or the corresponding lactones, for example polyethylene terephthalate, polybutylene terephthalate, poly-1,4-dimethylolcyclohexane terephthalate, polyalkylene naphthalate (PAN) and polyhydroxybenzoates, as well as block copolyether esters derived from hydroxyl-terminated polyethers; and also polyesters modified with polycarbonates or MBS.

Polycarbonates and polyester carbonates.

Polysulfones, polyether sulfones and polyether ketones.

Crosslinked polymers derived from aldehydes on the one hand and phenols, ureas and melamines on the other hand, such as phenol/formaldehyde resins, urea/formaldehyde resins and melamine/formaldehyde resins.

Unsaturated polyester resins derived from copolyesters of saturated and unsaturated dicarboxylic acids with polyhydric alcohols and vinyl compounds as crosslinking agents, and also halogen-containing modifications thereof of low flammability.

Crosslinkable acrylic resins derived from substituted acrylates, for example epoxy acrylates, urethane acrylates or polyester acrylates.

Alkyd resins, polyester resins and acrylate resins crosslinked with melamine resins, urea resins, isocyanates, isocyanurates, polyisocyanates or epoxy resins.

Crosslinked epoxy resins derived from aliphatic, cycloaliphatic, heterocyclic or aromatic glycidyl compounds, e.g. products of diglycidyl ethers of bisphenol A and bisphenol F, which are crosslinked with customary hardeners such as anhydrides or amines, with or without accelerators.

Blends and alloys of the aforementioned polymers (polyblends), for example PP/EPDM, Polyamide/EPDM or ABS, PVC/EVA, PVC/ABS, PVC/MBS, PC/ABS, PC/Polyester, PBTP/ABS, PC/ASA, PC/PBT, PVC/CPE, PVC/acrylates, POM/thermoplastic PUR, PC/thermoplastic PUR, POM/acrylate, POM/MBS, PPO/HIPS, PPO/PA 6.6 and copolymers, PA/HDPE, PA/PP, PA/PPO, PBT/PC/ABS or PBT/PET/PC.

The spray tip is often a color-changing nozzle. The color-changing aspects of the invention above, use thermochromism which is typically implemented via one of two common approaches: liquid crystals and leuco dyes. Liquid crystals are used in precision applications, as their responses can be engineered to accurate temperatures, but their color range is limited by their principle of operation. Leuco dyes allow wider range of colors to be used, but their response temperatures are more difficult to set with accuracy.

Some liquid crystals are capable of displaying different colors at different temperatures. This change is dependent on selective reflection of certain wavelengths by the crystalline structure of the material, as it changes between the low-temperature crystalline phase, through anisotropic chiral or twisted nematic phase, to the high-temperature isotropic liquid phase. Only the nematic mesophase has thermochromic properties. This restricts the effective temperature range of the material.

The twisted nematic phase has the molecules oriented in layers with regularly changing orientation, which gives them periodic spacing. The light passing through the crystal undergoes Bragg diffraction on these layers, and the wavelength with the greatest constructive interference is reflected back, which is perceived as a spectral color. A change in the crystal temperature can result in a change of spacing between the layers and therefore in the reflected wavelength. The color of the thermochromic liquid crystal can therefore continuously range from non-reflective (black) through the spectral colors to black again, depending on the temperature. Typically, the high temperature state will reflect blue-violet, while the low-temperature state will reflect red-orange. Since blue is a shorter wavelength than red, this indicates that the distance of layer spacing is reduced by heating through the liquid-crystal state.

Some such materials are cholesteryl nonanoate or cyanobiphenyls. Liquid crystals used in dyes and inks often come microencapsulated, in the form of suspension. Liquid crystals are used in applications where the color change has to be accurately defined.

Thermochromic dyes are based on mixtures of leuco dyes with suitable other chemicals, displaying a color change (usually between the colorless leuco form and the colored form) in dependence on temperature. The dyes are rarely applied on materials directly; they are usually in the form of microcapsules with the mixture sealed inside. An illustrative example would include microcapsules with crystal violet lactone, weak acid, and a dissociable salt dissolved in dodecanol; when the solvent is solid, the dye exists in its lactone leuco form, while when the solvent melts, the salt dissociates, the pH inside the microcapsule lowers, the dye becomes protonated, its lactone ring opens, and its absorption spectrum shifts drastically, therefore it becomes deeply violet. In this case the apparent thermochromism is in fact halochromism.

The dyes most commonly used are spirolactones, fluorans, spiropyrans, and fulgides. The weak acids include bisphenol A, parabens, 1,2,3-triazole derivates, and 4-hydroxycoumarin and act as proton donors, changing the dye molecule between its leuco form and its protonated colored form; stronger acids would make the change irreversible.

Leuco dyes have less accurate temperature response than liquid crystals. They are suitable for general indicators of approximate temperature. They are usually used in combination with some other pigment, producing a color change between the color of the base pigment and the color of the pigment combined with the color of the non-leuco form of the leuco dye. Organic leuco dyes are available for temperature ranges between about 23° F. (−5° C.) and about 140° F. (60° C.), in wide range of colors. The color change usually happens in about a 5.4° F. (3° C.) interval.

The size of the microcapsules typically ranges between 3-5 μm (over 10 times larger than regular pigment particles), which requires some adjustments to printing and manufacturing processes.

Thermochromic paints use liquid crystals or leuco dye technology. After absorbing a certain amount of light or heat, the crystalline or molecular structure of the pigment reversibly changes in such a way that it absorbs and emits light at a different wavelength than at lower temperatures.

The thermochromic dyes contained either within or affixed upon either the disposable nozzle or hoses may be configured to change the color of the composition in various ways. For example, in one embodiment, once the composition reaches a selected temperature, the composition may change from a base color to a white color or a clear color. In another embodiment, a pigment or dye that does not change color based on temperature may be present for providing a base color. The thermochromic dyes, on the other hand, can be included in order to change the composition from the base color to at least one other color.

In one particular embodiment, the plurality of thermochromic dyes are configured to cause the cleansing composition to change color over a temperature range of at least about 3° C., such as at least about 5° C., once the composition is heated to a selected temperature. For example, multiple thermochromic dyes may be present within the cleansing composition so that the dyes change color as the composition gradually increases in temperature. For instance, in one embodiment, a first thermochromic dye may be present that changes color at a temperature of from about 23° C. to about 28° C. and a second thermochromic dye may be present that changes color at a temperature of from about 27° C. to about 32° C. If desired, a third thermochromic dye may also be present that changes color at a temperature of from about 31° C. to about 36° C. In this manner, the cleansing composition changes color at the selected temperature and then continues to change color in a stepwise manner as the temperature of the composition continues to increase. It should be understood that the above temperature ranges are for exemplary and illustrative purposes only.

Any thermochromic substance that undergoes a color change at the desired temperature may generally be employed in the present disclosure. For example, liquid crystals may be employed as a thermochromic substance in some embodiments. The wavelength of light ("color") reflected by liquid crystals depends in part on the pitch of the helical structure of the liquid crystal molecules. Because the length of this pitch varies with temperature, the color of the liquid crystals is also a function of temperature. One particular type of liquid crystal that may be used in the present disclosure is a liquid crystal cholesterol derivative. Exemplary liquid crystal cholesterol derivatives may include alkanoic and aralkanoic acid esters of cholesterol, alkyl esters of cholesterol carbonate, cholesterol chloride, cholesterol bromide, cholesterol acetate, cholesterol oleate, cholesterol caprylate, cholesterol oleyl-carbonate, and so forth. Other suitable liquid crystal compositions are possible and contemplated within the scope of the invention.

In addition to liquid crystals, another suitable thermochromic substance that may be employed in the present disclosure is a composition that includes a proton accepting chromogen ("Lewis base") and a solvent. The melting point of the solvent controls the temperature at which the chromogen will change color. More specifically, at a temperature below the melting point of the solvent, the chromogen generally possesses a first color (e.g., red). When the solvent is heated to its melting temperature, the chromogen may become protonated or deprotonated, thereby resulting in a shift of the absorption maxima. The nature of the color change depends on a variety of factors, including the type of proton-accepting chromogen utilized and the presence of any additional temperature-insensitive chromogens. Regardless, the color change is typically reversible.

Although not required, the proton-accepting chromogen is typically an organic dye, such as a leuco dye. In solution, the protonated form of the leuco dye predominates at acidic pH levels (e.g., pH of about 4 or less). When the solution is made more alkaline through deprotonation, however, a color change occurs. Of course, the position of this equilibrium may be shifted with temperature when other components are present. Suitable and non-limiting examples of leuco dyes for use in the present disclosure may include, for instance, phthalides; phthalanes; substituted phthalides or phthalanes, such as triphenylmethane phthalides, triphenylmethanes, or diphenylmethanes; acyl-leucomethylene blue compounds; fluoranes; indolylphthalides, spiropyranes; cumarins; and so forth. Exemplary fluoranes include, for instance, 3,3'-dimethoxyfluorane, 3,6-dimethoxyfluorane, 3,6-di-butoxyfluorane, 3-chloro-6-phenylamino-flourane, 3-diethylamino-6-dimethylfluorane, 3-diethylamino-6-methyl-7-chlorofluorane, and 3-diethyl-7,8-benzofluorane, 3,3'-bis-(p-dimethyl-aminophenyl)-7-phenylaminofluorane, 3-diethylamino-6-methyl-7-phenylamino-fluorane, 3-diethylamino-7-phenyl-aminofluorane, and 2-anilino-3-methyl-6-diethylamino-fluorane. Likewise, exemplary phthalides include 3,3',3"-tris(p-dimethylamino-phenyl)phthalide, 3,3'-bis(p-dimethyl-aminophenyl)phthalide, 3,3-bis(p-diethylamino-phenyl)-6-dimethylamino-phthalide, 3-(4-diethylaminophenyl)-3-(1-ethyl-2-methylindol-3-yl)phthalide, and 3-(4-diethylamino-2-methyl)phenyl-3-(1,2-dimethylindol-3-yl)phthalide.

Although any solvent for the thermochromic dye may generally be employed in the present disclosure, it is typically desired that the solvent have a low volatility. For example, the solvent may have a boiling point of about 150° C. or higher, and in some embodiments, from about 170° C. to 280° C. Likewise, the melting temperature of the solvent is also typically from about 25° C. to about 40° C., and in some embodiments, from about 30° C. to about 37° C. Examples of suitable solvents may include saturated or unsaturated alcohols containing about 6 to 30 carbon atoms, such as octyl alcohol, dodecyl alcohol, lauryl alcohol, cetyl alcohol, myristyl alcohol, stearyl alcohol, behenyl alcohol, geraniol, etc.; esters of saturated or unsaturated alcohols containing about 6 to 30 carbon atoms, such as butyl stearate, methyl stearate, lauryl laurate, lauryl stearate, stearyl laurate, methyl myristate, decyl myristate, lauryl myristate, butyl stearate, lauryl palmitate, decyl palmitate, palmitic acid glyceride, etc.; azomethines, such as benzylideneaniline, benzylidenelaurylamide, o-methoxybenzylidene laurylamine, benzylidene p-toluidine, p-cumylbenzylidene, etc.; amides, such as acetamide, stearamide, etc.; and so forth.

The thermochromic composition may also include a proton-donating agent (also referred to as a "color developer") to facilitate the reversibility of the color change. Such proton-donating agents may include, for instance, phenols, azoles, organic acids, esters of organic acids, and salts of organic acids. Exemplary phenols may include phenylphenol, bisphenol A, cresol, resorcinol, chlorolucinol, b-naphthol, 1,5-dihydroxynaphthalene, pyrocatechol, pyrogallol, trimer of p-chlorophenol-formaldehyde condensate, etc. Exemplary azoles may include benzotriaoles, such as 5-chlorobenzotriazole, 4-laurylaminosulfobenzotriazole, 5-butylbenzotriazole, dibenzotriazole, 2-oxybenzotriazole, 5-ethoxycarbonylbenzotriazole, etc.; imidazoles, such as oxybenzimidazole, etc.; tetrazoles; and so forth. Exemplary organic acids may include aromatic carboxylic acids, such as salicylic acid, methylenebissalicylic acid, resorcylic acid, gallic acid, benzoic acid, p-oxybenzoic acid, pyromellitic acid, b-naphthoic acid, tannic acid, toluic acid, trimellitic acid, phthalic acid, terephthalic acid, anthranilic acid, etc.; aliphatic carboxylic acids, such as stearic acid, 1,2-hydroxystearic acid, tartaric acid, citric acid, oxalic acid, lauric acid, etc.; and so forth. Exemplary esters may include alkyl esters of aromatic carboxylic acids in which the alkyl moiety has 1 to 6 carbon atoms, such as butyl gallate, ethyl p-hydroxybenzoate, methyl salicylate, etc.

The amount of the proton-accepting chromogen employed may generally vary, but is typically from about 2 wt. % to about 20 wt. %, and in some embodiments, from about 5 to about 15 wt. % of the thermochromic substance. Likewise, the proton-donating agent may constitute from about 5 to about 40 wt. %, and in some embodiments, from about 10 wt. % to about 30 wt. % of the thermochromic substance. In addition, the solvent may constitute from about 50 wt. % to about 95 wt. %, and in some embodiments, from about 65 wt. % to about 85 wt. % of the thermochromic composition.

Regardless of the particular thermochromic substance employed, it may be microencapsulated to enhance the stability of the substance during processing. For example, the thermochromic substance may be mixed with a thermosetting resin according to any conventional method, such as interfacial polymerization, in-situ polymerization, etc. The thermosetting resin may include, for example, polyester resins, polyurethane resins, melamine resins, epoxy resins, diallyl phthalate resins, vinylester resins, and so forth. The resulting mixture may then be granulated and optionally coated with a hydrophilic macromolecular compound, such as alginic acid and salts thereof, carrageenan, pectin, gelatin and the like, semisynthetic macromolecular compounds such as methylcellulose, cationized starch, carboxymethylcellulose, carboxymethylated starch, vinyl polymers (e.g., polyvinyl alcohol), polyvinylpyrrolidone, polyacrylic acid, polyacrylamide, maleic acid copolymers, and so forth. The resulting thermochromic microcapsules typically have a size of from about 1 to about 50 micrometers, and in some embodiments, from about 3 to about 15 micrometers. Various other microencapsulation techniques may also be used.

Thermochromic dyes are commercially available from various sources. In one embodiment, for instance, thermochromic dyes marketed by Chromadic creations, Hamilton, Ontario and sold under the trade name SpectraBurst Thermochromic Polypropylene.

The thermochromic dyes can be present in the composition in an amount sufficient to have a visual effect on the color of the composition. The amount or concentration of the dyes can also be increased or decreased depending upon the desired intensity of any color. In general, the thermochromic dyes may be present in the composition in an amount from about 0.01% by weight to about 9% by weight, such as from about 0.1% by weight to about 3% by weight. For instance, in one particular embodiment, the thermochromic dyes may be present in an amount from about 0.3% to about 1.5% by weight.

As described above, thermochromic dyes typically change from a specific color to clear at a certain temperature, e.g., dark blue below 60° F. (15.6° C.) to transparent or translucent above 60° F. (15.6° C.). If desired, other pigments or dyes can be added to the composition in order to provide a background color that remains constant independent of the temperature of the composition. By adding other pigments or dyes in combination with the thermochromic dyes to the composition, the thermochromic dyes can provide a color change at certain temperatures rather than just a loss of color should the thermochromic dye become clear. For instance, a non-thermochromic pigment, such as a yellow pigment, may be used in conjunction with a plurality of thermochromic dyes, such as a red dye and a blue dye. When all combined together, the cleansing composition may have a dark color. As the composition is increased in temperature, the red thermochromic dye may turn clear changing the color to a green shade (a combination of yellow and blue). As the temperature further increases, the blue thermochromic dye turns clear causing the composition to turn yellow.

It should be understood that all different sorts of thermochromic dyes and non-thermochromic pigments and dyes may be combined to produce a composition having a desired base color and one that undergoes desired color changes. The color changes, for instance, can be somewhat dramatic and fanciful. For instance, in one embodiment, the composition may change from green to yellow to red.

In an alternative embodiment, however, the composition can contain different thermochromic dyes all having the same color. As the temperature of the composition is increased, however, the shade or intensity of the color can change. For instance, the composition can change from a vibrant blue to a light blue to a clear color. In addition to the above, many alterations and permutations are possible. Any of a variety of colors and shades can be mixed to undergo color changes as a function of temperature.

The best mode for carrying out the invention has been described for purposes of illustrating the best mode known to the applicant at the time. The examples are illustrative only and not meant to limit the invention, as measured by the scope and merit of the claims. The invention has been described with reference to preferred and alternate embodiments. Obviously, modifications and alterations will occur to others upon the reading and understanding of the specification. It is intended to include all such modifications and alterations insofar as they come within the scope of the appended claims or the equivalents thereof.

What is claimed is:

1. A thermoset or thermoplastic color-changing polymeric spray tip nozzle for the non-longitudinally axially spraying of two-component polyurethane aerosols which comprises:

an expanded nozzle housing at a distal end for affixing to a mating housing of a spray gun, the spray tip nozzle having an anterior flat end and an open distal opposed end and a radially-expanding circumferential side section adjacent the anterior flat end, the radially-expanding circumferential side section increasing in outer diameter from the anterior flat end toward the distal end of the housing;

an elongated body having a mixing chamber adjacent and in fluid communication with the expanded nozzle housing;

the nozzle having a longitudinal axis running from the distal end to the anterior flat end, the anterior flat end of the nozzle being normal to the longitudinal axis of the nozzle;

a nozzle egress opening adjacent the anterior flat end of the housing in fluid communication with the mixing chamber, the nozzle having an angled egress opening slit which is adjacent the anterior flat end and at the radially-expanding circumferential side section, wherein the angled egress opening slit comprises a pair of lips adjacent the egress opening of the nozzle, and wherein the pair of lips include an upper lip and a lower lip, the upper lip forming a non-normal angle $\alpha$ to the longitudinal axis of the elongated body of the nozzle and the lower lip extending from the nozzle egress opening at a non-normal angle $\beta$ to the longitudinal axis of elongated body of the nozzle, the upper lip extending toward the mixing chamber to an elevation below where the lower lip extends from the nozzle egress opening at the non-normal angle $\beta$; and an attachment means for affixing the nozzle to a spray gun at the expanded nozzle housing wherein the attachment means is a resiliently biased finger having a protruding lip for affixing to a mating depression on the spray gun.

2. The spray tip nozzle of claim 1 wherein the pair of lips form an off-axis V-shape; and further wherein angle $\alpha$ is always smaller than angle $\beta$.

3. The spray tip nozzle of claim 2 wherein angle $\alpha$ ranges from 5° to 45° inclusive; and angle $\beta$ is at least 5° greater than angle $\alpha$.

4. The spray tip nozzle of claim 3 wherein angle $\beta$ is always at least 10° greater than angle $\alpha$.

5. The spray tip nozzle of claim 4 wherein angle $\beta$ is always at least 25° greater than angle $\alpha$.

6. The spray tip nozzle of claim 5 wherein angle $\beta$ is always at least 40° greater than angle $\alpha$.

7. The spray tip nozzle of claim 1 wherein the angle $\alpha$ is smaller than the angle $\beta$, and wherein the angle $\beta$ is less than 90°.

* * * * *